United States Patent [19]

Morita et al.

[11] Patent Number: 4,817,571

[45] Date of Patent: Apr. 4, 1989

[54] METHOD AND APPARATUS FOR FUEL CONTROL

[75] Inventors: Kiyomi Morita, Katsuta; Junji Miyake, Mito; Keiji Hatanaka, Chigasaki; Kiyotoshi Sakuma, Yokohama, all of Japan

[73] Assignee: Hitachi, Ltd., Tokyo, Japan

[21] Appl. No.: 91,873

[22] Filed: Sep. 1, 1987

[30] Foreign Application Priority Data

Sep. 1, 1986 [JP] Japan ..... 61-203713

[51] Int. Cl.[4] ..... F02D 41/10

[52] U.S. Cl. ..... 123/492

[58] Field of Search ..... 123/492, 486, 480

[56] References Cited

U.S. PATENT DOCUMENTS 4,401,087 8/1983 Ikeura ..... 123/492
4,454,847 6/1984 Isomura et al. ..... 123/492
4,640,254 2/1987 Ninomiya ..... 123/492

FOREIGN PATENT DOCUMENTS 58-107825 6/1983 Japan ..... 123/492
58-185949 10/1983 Japan .
58-214629 12/1983 Japan ..... 123/492

*Primary Examiner*—Andrew M. Dolinar
*Attorney, Agent, or Firm*—Antonelli, Terry & Wands

[57] ABSTRACT

An amount of fuel fed to an engine and determined by the rpm of the engine and a suction air flow rate is increased by a predetermined amount of fuel upon detection of acceleration. When the engine is suddenly accelerated from a low-speed operational region to enter a power zone, the above-mentioned predetermined amount of fuel is corrected based on the rpm of the engine and a quantity of change in the throttle valve opening degree.

9 Claims, 4 Drawing Sheets

METHOD AND APPARATUS FOR FUEL CONTROL

BACKGROUND OF THE INVENTION

This invention relates to a method and apparatus for fuel control of an internal combustion engine for a motor vehicle and, more particularly, to a method and apparatus for fuel control, which are capable of supplying an engine with fuel of a suitable amount when an operational condition of the engine has been changed from a low-speed operational condition to a suddenly-accelerated condition such as a fully opened throttle valve.

In general, a flow rate of air flowing into an engine varies in proportion to an opening degree of a throttle valve. However, when the throttle valve, in a fully-closed state, is operated to fully open state, the air flow does not respond since the air suction passage has a length from the engine to the throttle valve and an air flow rate sensor is provided on the upstream side of the throttle valve. When the throttle valve is moved in an opening direction thereof, the engine is accelerated, and the A/F (air-fuel) ratio must be reduced. However, due to the above arrangement, the air flow passing at the air flow rate sensor has not reached an air flow rate corresponding to the throttle opening as yet. Therefore, when a flow rate of sucked or drawn in air is detected by the air flow rate sensor, an optimum fuel supply amount is calculated based on this flow rate and the fuel is ejected by an injector. Therefore, the A/F (air-fuel) ratio increases (fuel is lean), and the engine is not sufficiently accelerated. In order to eliminate this inconvenience, a method of correcting the control delay has been employed, in which the fuel feed rate is determined by the air flow rate sensor in accordance with the degree of opening of the throttle valve.

In the conventional acceleration correcting system using a throttle sensor disclosed in Japanese patent laid-open No. 185949/1983, the so-called fuel increment correction for acceleration is carried out, in which, when the quantity of variation per predetermined period of time, i.e. differentiation quantity, of an output from the throttle sensor is detected and the quantity of variation of the throttle sensor output exceeds a predetermined level, the fuel feed rate which is computed based on the air suction rate detected by the air flow rate sensor is multiplied by a certain coefficient, for example, 1.1, to increase the fuel feed rate.

However, the conventional acceleration correction system has the following drawbacks. Namely, when the engine is suddenly accelerated to such an extent that the throttle valve is fully opened while the engine is in a low-speed operation, for example, at 800–1000 rpm, the air suction rate increases in accordance with the increase in the degree of opening of the throttle valve but the fuel feed rate does not sufficiently increase in spite of increase of fuel for the acceleration because the fuel is deposited on the inner surface of the manifold. Consequently, desired acceleration characteristics cannot be obtained. If the fuel increase for acceleration is increased on every occasion when the engine is accelerated so as to eliminate these inconveniences, the mixing ratio of the fuel in an operational range other than the fuel injection rate increasing operational range, a so-called power zone increases, so that emissions in the exhaust gas are diminished.

SUMMARY OF THE INVENTION

An object of the present invention is to provide a fuel control method and apparatus for improving operational characteristics of an engine when the engine is suddenly accelerated from a low-speed operational range.

According to the present invention, in a fully-opened low-speed operational range, fuel is injected more than a regular increment of fuel for acceleration by an amount of fuel deposited on an inner wall of the suction passage, in particular, of the manifold thereby to improve operational characteristics when the engine is suddenly accelerated fron the low-speed operational range.

Namely, the present invention provides a fuel control method and apparatus, wherein an amount of fuel fed to the engine and determined by the number of revolutions of the engine and a suction air flow rate is increased by a predetermined amount of fuel upon detection of acceleration, and which are characterized in that when a load has exceeded a predetermined level while the engine runs at a rpm lower than the predetermined value, the above-mentioned predetermined amount of fuel is corrected based on the rpm of the engine and a quantity of change in load.

Figure 1:
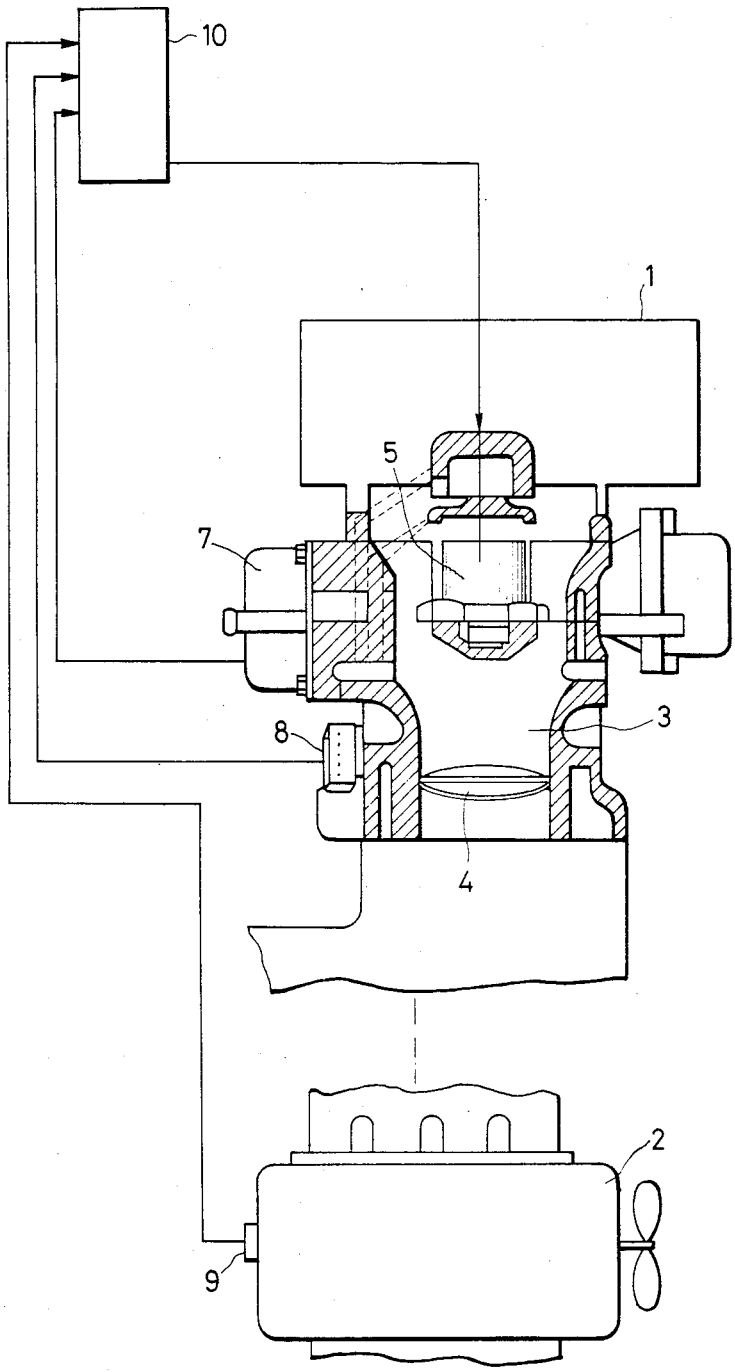
FIG. 1 is a schematic view of a fuel injection system constructed in accordance with the present invention.

Referring now to the drawings wherein like reference numerals are used throughout the various views to designate like parts and, more particularly, to FIG. 1, according to this figure, an internal combustion engine 2 communicates with an air cleaner 1 by way of an intake passage 3 to suck or draw air through the air cleaner 1, with the intake passage 3 having a portion formed in a manifold through which air is supplied to the respective engine cylinders (not shown) during a suction stroke of the respective engine cylinders. A throttle valve 4 is provided in the intake passage 3 in which a fuel injection 5 is disposed on an upstream side of the throttle valve 4.

In this construction, the throttle valve 4 is actuated by an accelerator pedal (not shown) to open and close. As the throttle valve 4 is opened, the engine 2 sucks or draws air through the intake passage 3 during a suction stroke of the respective cylinders.

The flow rate of the air sucked or drawn into the engine 2 is measured with an air flow rate sensor 7. A value determined by this air flow rate sensor 7 is inputted into a control unit 10. In this control unit 10, pulses outputted from a crank angle sensor 9 are counted to determine the rpm N of the engine 2, a feed rate of the fuel is calculated based on the air flow rate and the rpm N and output pulses corresponding to this feed rate are outputted to the injector 5. The fuel is then ejected from the fuel injector 5 at a rate corresponding to the number of the pulses supplied thereto. Let Qa equal a suction rate of the air, and N the rpm of the engine 2. A basic width Tp of a pulse supplied to the injector 5 can then be expressed by the following equation:

$$Tp=k\times Qa/N \quad (1)$$

wherein k is a constant.

On the other hand, outputs, which represent the degree of opening of the throttle valve 4, from a throttle sensor 8 are inputted to the control unit 10 every t1 msec, for example, 10 msec, to examine an amount of change in the throttle opening at an interval of t msec.

Let $\theta x$ equal the latest degree of opening of the throttle valve, and $\theta x-1$ the degree opening of the throttle valve at an instant $t_1$ msec before. When $\theta x-\theta x-1 \geqq \Delta\theta_3$, the condition of the engine is regarded as the accelerated condition, and an acceleration correction coefficient Kd is set. This coefficient Kd serves to correct injection pulse width during the acceleration of the automobile according to the following equation;

$$Ti=Tp\times(1+Kmr+Kd) \quad (2)$$

wherein Ti is the injection pulse width;

Tp the basic pulse width obtained by the equation (1); and Kmr a fully opening fuel feed rate increasing correction coefficient which is a fuel increment coefficient for increasing fuel more than a magnitude determined depending upon the suction rate of air $Q_a$ and the rpm N of the engine when the engine is in conditions such that the throttle valve is fully opened in normal operational conditions other than acceleration, for example.

Figure 2:
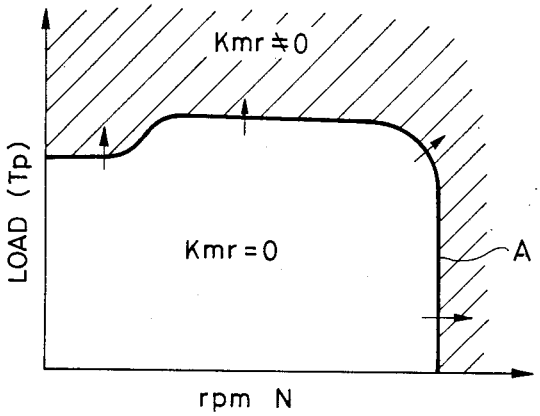
FIG. 2 is a graphical illustration depicting the correction starting conditions.

In operational conditions of the engine, presuming the fuel corrected according to the acceleration correction coefficient Kd is injected, a power zone depending on the rpm N of the engine and a load, as outside the area enclosed by a solid line A of FIG. 2 exists. This power zone is a zone in which a sufficient engine power is not generated unless a fuel/air mixing ratio is set higher (fuel rich) than on a regular occasion. In such a case, fuel is increased depending on the fully opening fuel feed rate coefficient or a power zone fuel feed rate increasing correction coefficient $K_{mr}$. When the motor vehicle, in a regular travelling condition, enters this power zone, the fuel runs short if it is fed at a regular rate.

Especially, when a motor vehicle running in an operational region of less than 2000 rpm is suddenly accelerated, with the throttle valve 4 fully opened, to enter the power zone which is shown by hatching in FIG. 2, according to a conventional fuel control apparatus, the acceleration injection is simply carried out, i.e., a fuel increment for the acceleration is injected in addition to a fuel amount necessary for regular speed running. Namely, the fuel is supplied according to the equation (2). However, some of the fuel increment for the acceleration is deposited on the inner surface of the intake manifold, and does not serve to generate substantial power of the engine. The fuel deposition amount increases as the engine load increases, and the fuel deposition amount remarkably increases in a low speed fully-opened operational region.

Figure 3A:
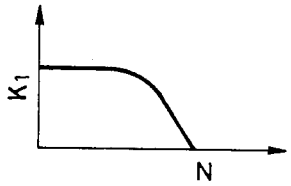
FIGS. 3(A) to 3(C) are graphical illustration depicting fuel feed rate correction factors.
Figure 3B:
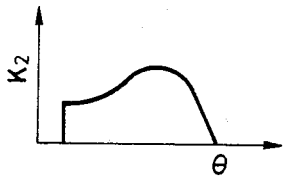
Figure 3C:
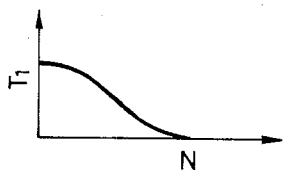

In the emodiment of the present invention, the fuel is controlled so as to increase further fuel injection rate on the basis of correction factors shown in FIG. 3. As shown in FIG. 3(A), one of them is a fuel increment correction coefficient $K_1$ which varies depending upon the rpm N of the engine 2, and, when the rpm N of the engine is large, the fuel increment correction coefficient K1 may be small because a fuel deposition amount on the manifold is small when the engine runs at a large rpm N. Another factor is a fuel increment correction coefficient $K_2$ the magnitude of which varies (refer to FIG. 3(B)) in dependence upon a variation of a load, for example, a variation of the degree of opening of the throttle valve 4. The suction vacuum may be used as a variation of the load. The time $T_1$ for which the correction pulses are applied differs with this correction coefficient. This correction pulse application time $T_1$ has characteristics such as shown in FIG. 3(C), which changes with respect to the rpm N of the engine 2.

This correction pulse application time $T_1$ is a period of time for increasing the feed rate of the fuel until the fuel deposited on the inner surface of the manifold has entered the combustion chamber.

When the operational conditions for the engine 2 enter the power zone after the starting of the acceleration has been ascertained, the product $K_{ac}$ (=K1×K2) of the correction coefficients K1, K2 is added to the power zone fuel feed rate increasing correction coefficient Kmr. Namely, in such a case, fuel is injected according to the following equation:

$$T_i=T_p\times(1+K_{mr}+K_d+K_{ac}) \quad (3)$$

$K_{mr}+K_{ac}$ can be given as follows:

$$K_{mr}+K_{ac}=K_{mr}'=K_{mr}(1+K_{ac}')$$

wherein $K_{ac}'=K_{ac}/K_{mr}$. Namely, during the time $T_1$ fuel is corrected by Kmr'=Kmr×(1+Kac'). The time $T_1$ starts to be measured at an instant at which the operation of the engine enters the power zone during the acceleration thereof.

$K_{mr}$ is obtained through experiments. For example, the engine 2 under the conditions of a certain load and a certain rpm N is operated so that the engine 2 will be in an optimum operational condition. In this case, $K_{mr}$ is calculated based on the fuel injection according to the equation (2). Such experiments are conducted all over the operational regions and the $K_{mr}$ obtained is stored as a map in the control unit 10 in advance. The map is as shown in FIG. 2 (in which data is not plotted). $K_{mr}$ is easily read out by indexing the rpm N and the load (or throttle valve opening degree $\theta$).

$K_1$, $K_2$ and $T_1$ also are obtained through experiments and stored as maps as shown in FIG. 3. Additionally $K_{ac}$ may be obtained through experiments).

Figure 4:
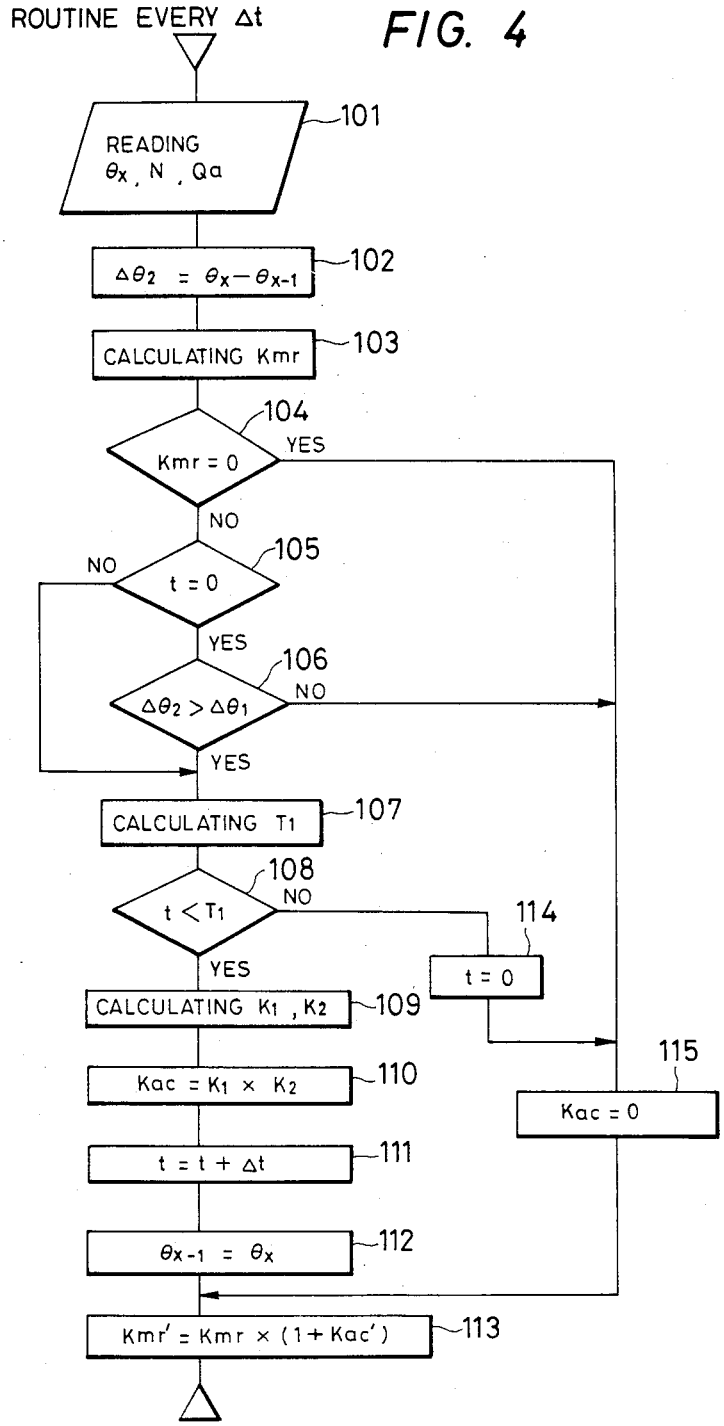
FIG. 4 is a flow chart of a control operation for determining a power zone fuel-increasing correction coefficient $K_{mr}$.

Referring to FIG. 4, the degree of opening $\theta x$ of the throttle valve 4, the rpm N of the engine 2 and an air suction rate Qa are read in a step 101, and a difference $\Delta\theta_2$ between this degree of opening $\theta x$ and the preceding read value $\theta_{x-1}$ of the degree of opening of the throttle valve 4 is calculated in a step 102, the power zone fuel feed rate increasing correction coefficient Kmr being calculated or read out in a step 103 on the basis of the rpm N of the engine and air suction rate Qa (or the degree of opening $\theta$ of the throttle valve 4). In a step 104, a comparison is made to ascertain that Kmr=0. When Kmr=0, the engine is not in the power zone as shown in FIG. 2 and a coefficient Kac is set to zero in a step 115. When Kmr≠0, a comparison is made in a step 105 to ascertain that a counted value t is zero. When t=0, a comparison is made in a step 106 to ascertain that $\Delta\theta_2$ is larger than a predetermined value $\Delta\theta_1$. When $\Delta\theta_2$ is smaller than $\Delta\theta_1$, Kac is set to zero in a step 115. When $\Delta\theta_2$ is larger than $\Delta\theta_1$, the correction pulse application time $T_1$ is read out in a step 107 with reference to the map shown in FIG. 3(C), and a comparison is made in a step 108 to ascertain that the counted value t is smaller than the value of the correction pulse application time $T_1$. When the counted value t is larger than the value of $T_1$, the counted value t is set to zero in a step 114, and Kac to zero in a step 115. When the counted value t is less than the value of the correction pulse application time $T_1$, the correction coefficients $K_1$, $K_2$ are determined in a step 109 with reference to the maps shown in FIGS. 3A and 3B, and Kac is calculated in a step 110 in accordance with the equation $Kac=K_1\times K_2$, the counted value t being increased by $\Delta t$ in a step 111, $\theta_x$ being set equal to $\theta_{x-1}$ in a step 112 to calculate $\Delta\theta_2$ for the subsequent routine and make preparations therefor, the power zone fuel feed rate increasing coefficient being corrected in a step 113 in accordance with the equation $Kmr'=Kmr\times(1+Kac)$. When the counted value t is not zero in the step 105, $T_1$ is read from the map in the step 107.

Figure 5:
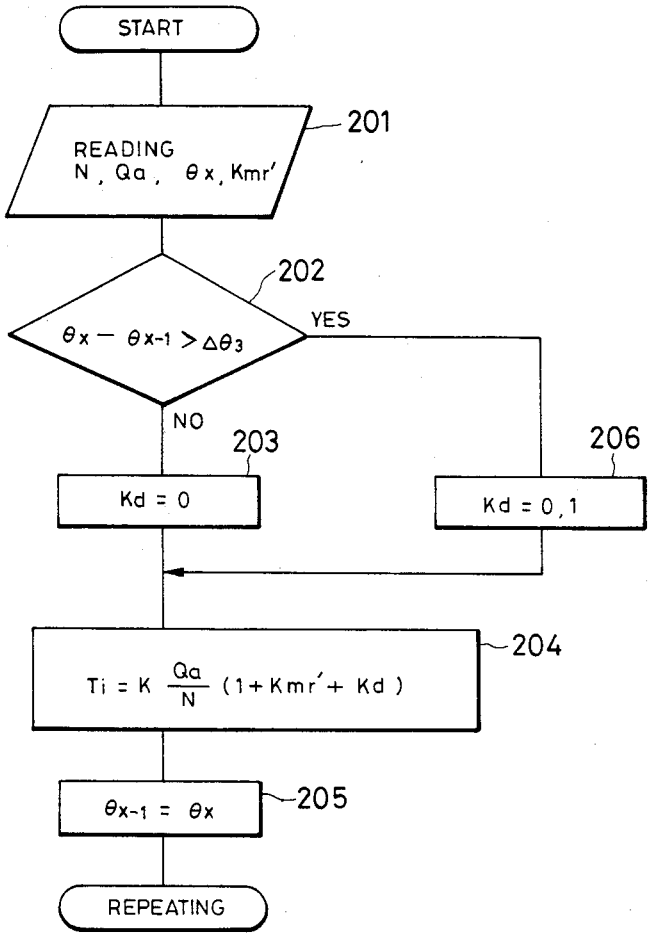
FIG. 5 is a flow chart of a control operation for determining a fuel injection pulse width Ti.

As shown in FIG. 5, the number of revolutions per minute N of the engine, air suction rate Qa, degree of opening $\theta x$ of the throttle valve 4 and Kmr' determined in the flow of the control operation of FIG. 4 are read in a step 201, and a comparison is made in a step 202 to ascertain that a difference between the actual degree of opening $\theta_x$ and the preceding degree of opening $\theta_{x-1}$ is larger than a predetermined value $\Delta\theta_3$. When this difference is not more than $\Delta\theta_3$, the acceleration correction coefficient Kd is set to zero in a step 203, and the injection pulse width Ti is determined in a step 204 in accordance with the equation $Ti=K\text{-}(Qa/N)(1+Kmr'+Kd)$ to set the injector so that the fuel is injected at a predetermined crank angle, $\theta_x$ being set equal to $\theta_{x-1}$ in a step 205 to make preparations for the subsequent computation. When the above-mentioned difference is larger than $\Delta\theta_3$, Kd is set to 0.1, for example, in a step 206, and Ti is determined in the step 204, $\theta_x$ being set equal to $\theta_{x-1}$.

According to the present invention described above, the operational characteristics of the engine 2 at the time of sudden asceleration thereof from a low-speed operational range can be improved.

What is claimed is:

1. A method of fuel control which includes a step of fuel increment for acceleration, wherein a fuel feed rate which is determined depending upon the number of revolutions per unit time of the engine and an air suction rate is increased by a predetermined degree when acceleration is detected, the method comprising the steps of detecting whether or not a load of the engine, running at a low speed with the number of revolutions per unit time of the engine not more than a predetermined level, has exceeded a predetermined level after acceleration; and correcting, in addition to increase in the fuel feed rate to be effected in said step of fuel increment for acceleration, the fuel feed rate so as to further increase on the basis of the number of revolutions per unit time of the engine in practical operation and a quantity of variation of the load when it is detected in said detecting step that the engine is accelerated and the load has exceeded a predetermined level.

2. The method of fuel control according to claim 1, wherein whether or not the load of the engine has exceeded a predetermined level is detected through detection of a predetermined quantity in variation of the throttle valve opening degree.

3. The method of fuel control according to claim 1, wherein said predetermined degree of increase in the fuel feed rate is corrected when an operational condition of the engine is changed from a low-speed operational condition to a suddenly-accelerated condition such as a throttle valve is fully opened.

4. The method of fuel control according to claim 3, wherein said predetermined degree of increase in fuel feed rate is corrected during a period of time from a time of deposition of fuel on an inner surface of the manifold until the time that the fuel deposited on the inner surface has entered the combustion chambers of the engine.

5. In a fuel injection system comprising an intake passage including a manifold portion, and communicating with an air cleaner and an internal combustion engine for an automobile, a throttle valve provided to control a flow rate of air sucked into the engine through the intake passage, an air flow rate sensor adapted to detect a flow rate of air passing through said intake passage, a sensor provided to detect the member of revolution per unit time of the engine, a throttle sensor provided to detect an opening degree of said throttle, and fuel control apparatus having means for increasing by a predetermined degree when the acceleration is detected, a fuel feed rate which is determined depending upon the number of revolutions per unit time of the engine and an air suction rate, said fuel control apparatus characterized by comprising means for detecting whether or not a load has exceeded a predetermined level while a vehicle travels in a low speed with the number of revolutions per unit time of the engine not more than a predetermined level; and means for correcting, in addition to increase in the fuel feed rate to be effected by said means for increasing the fuel feed rate, the fuel fed rate so as to further increase on the basis of the number of revolutions per unit time of the engine in practical operation and a quantity of variation of the load when it is detected by said detecting means that the engine load has exceeded a predetermined level.

6. A method of fuel control of an internal combustion engine, including a step of fuel incrementation for acceleration according to an acceleration correction coefficient, wherein a fuel feed rate which is determined in dependence upon the number of revolutions per unit time of the engine and an air suction rate is increased by a predetermined degree when acceleration is detected, said method further comprising the steps of:

detecting a condition that the engine, in a low-speed operation, is accelerated;

detecting whether or not the engine has entered, after starting of the acceleration, a power zone in which the engine is operated at a low speed, with a throttle valve being fully opened, while fuel is being fed with an increment in dependence upon a power zone fuel feed rate increasing correction coefficient; and correcting the fuel feed rate so as to increase by a predetermined amount in addition to the fuel increments determined according to said acceleration correction coefficient and to said power zone fuel feed rate increasing correction coefficient for a predetermined period of time from a time that the engine has entered the power zone during the acceleration.

7. The method of fuel control according to claim 6, wherein said predetermined amount of fuel to be corrected in said correction step is determined according to a fuel increment coefficient $K_{ac}$ which is a product of a fuel increment correction coefficient $K_1$ varying in magnitude depending on the r.p.m. of the engine and a fuel increment correction coefficient $K_2$ varying in magnitude depending on a variation of a load.

8. The method of fuel control according to claim 7, wherein said correction step, said fuel is corrected for a period of time from the time the engine has entered the power zone until the fuel deposited on the inner surface of a manifold has entered the combustion chamber.

9. The method of fuel control according to claim 6, wherein said low-speed operation of the engine is an engine operation of less than 2,000 r.p.m.

* * * * *